US010824182B2

(12) United States Patent
Kamezawa et al.

(10) Patent No.: US 10,824,182 B2
(45) Date of Patent: Nov. 3, 2020

(54) SEMICONDUCTOR INTEGRATED CIRCUIT AND POWER SUPPLY DEVICE

(71) Applicants: Sho Kamezawa, Osaka (JP); Tohru Kanno, Kanagawa (JP)

(72) Inventors: Sho Kamezawa, Osaka (JP); Tohru Kanno, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/400,591

(22) Filed: May 1, 2019

(65) Prior Publication Data

US 2020/0004287 A1 Jan. 2, 2020

(30) Foreign Application Priority Data

Jun. 28, 2018 (JP) ..... 2018-123718

(51) Int. Cl.
*G05F 1/67* (2006.01)
*G05F 3/26* (2006.01)

(52) U.S. Cl.
CPC ..... *G05F 3/262* (2013.01)

(58) Field of Classification Search
CPC combination set(s) only.
See application file for complete search history.

(56) References Cited

U.S. PATENT DOCUMENTS 5,105,386 A * 4/1992 Andoh ..... G11C 16/0416 365/185.12
5,182,725 A * 1/1993 Andoh ..... G11C 16/0416 365/185.12
9,179,084 B2 * 11/2015 Yamaoka ..... H04N 5/374
2003/0102904 A1 * 6/2003 Mizuno ..... G11C 5/147 327/544
2004/0075489 A1 * 4/2004 Ohmae ..... G05F 3/262 327/543
2004/0207380 A1 * 10/2004 Ariki ..... G05F 3/262 323/313
2007/0114618 A1 * 5/2007 Ono ..... H01L 29/66643 257/410
2011/0317056 A1 * 12/2011 Matsumoto ..... H04N 5/365 348/308
2014/0132814 A1 * 5/2014 Ishii ..... H03M 1/0604 348/308
2017/0264844 A1 9/2017 Kamezawa et al.
2017/0269630 A1 9/2017 Kamezawa et al.
2018/0102156 A1 * 4/2018 Aikawa ..... G11C 11/161
(Continued)

FOREIGN PATENT DOCUMENTS

JP 2006-313765 11/2006
JP 2014-096758 5/2014

*Primary Examiner* — Adam D Houston
(74) *Attorney, Agent, or Firm* — Oblon, McClelland, Maier & Neustadt, L.L.P.

(57) ABSTRACT

A semiconductor integrated circuit includes a first power supply line, a second power supply line, and a voltage supplied circuit. The first power supply line is connected to a voltage supply source. The second power supply line is connected to the first power supply line at a connection point connecting a first point of the first power supply line and a second point of the second power supply line. The second point is included in a portion of the second power supply line excluding end portions of the second power supply line. The voltage supplied circuit is connected to the second power supply line.

11 Claims, 5 Drawing Sheets

(56) References Cited

U.S. PATENT DOCUMENTS

| | | | | |
|---|---|---|---|---|
| 2018/0249107 | A1 | 8/2018 | Kamezawa et al. | |
| 2018/0313874 | A1* | 11/2018 | Dix | G01R 19/10 |
| 2019/0156750 | A1* | 5/2019 | Dong | H01L 27/3276 |
| 2019/0302825 | A1* | 10/2019 | Hallikainen | G05F 3/30 |
| 2020/0004287 | A1* | 1/2020 | Kamezawa | G05F 3/262 |

* cited by examiner

-------- IR DROP ON LOCAL POWER SUPPLY LINE 121

— - - IR DROP ON POWER SUPPLY LINE 120

—— CURRENT OF CURRENT SOURCE TRANSISTORS M2-1 TO M2-n

SEMICONDUCTOR INTEGRATED CIRCUIT AND POWER SUPPLY DEVICE

CROSS-REFERENCE TO RELATED APPLICATION

This patent application is based on and claims priority pursuant to 35 U.S.C. § 119(a) to Japanese Patent Application No. 2018-123718 filed on Jun. 28, 2018, in the Japan Patent Office, the entire disclosure of which is hereby incorporated by reference herein.

BACKGROUND

Technical Field

The present invention relates to a semiconductor integrated circuit and a power supply device.

Description of the Related Art

A current mirror circuit has been known as a circuit capable of easily copying a current value. The current mirror circuit is used in a variety of circuits including an operational amplifier.

The current mirror circuit is often used in an analog circuit. In the analog circuit, the current value is a major parameter determining, for example, the mutual conductance gm, which is one of parameters of a transistor. Forming an accurate current mirror circuit therefore leads to improvement in overall quality of the analog circuit. In the current mirror circuit, a potential difference Vgs (i.e., the difference between a gate potential Vg and a source potential Vs) generated in a transistor of a bias generating circuit that receives a reference current is applied to one or more transistors to copy a current.

On a power supply line or a ground (GND) potential line, an TR drop occurs which is a voltage drop determined by an IR product, i.e., the product of a line resistance R of the line and a current I flowing through the line. That is, the IR drop changes the source potential Vs of the transistor, and thus the potential difference Vgs of the transistor forming the current mirror circuit also varies in accordance with the IR drop. The current generated by the transistor is proportional to a value $(Vgs-Vth)^2$, which is the square of the difference between the potential difference Vgs and a threshold voltage Vth. Consequently, the value of the current copied by the current mirror circuit is deviated from the value of the reference current by the value of the IR drop.

To reduce the above-described deviation in current value, the line resistance R may be reduced to reduce the IR drop.

SUMMARY

In one embodiment of this invention, there is provided an improved semiconductor integrated circuit that includes, for example, a first power supply line, a second power supply line, and a voltage supplied circuit. The first power supply line is connected to a voltage supply source. The second power supply line is connected to the first power supply line at a connection point connecting a first point of the first power supply line and a second point of the second power supply line. The second point is included in a portion of the second power supply line excluding end portions of the second power supply line. The voltage supplied circuit is connected to the second power supply line.

In one embodiment of this invention, there is provided an improved power supply device that includes, for example, the above-described semiconductor integrated circuit and a voltage supply source from which a power supply voltage is supplied.

In one embodiment of this invention, there is provided an improved semiconductor integrated circuit that includes, for example, means for connecting a voltage supply source to a first power supply line, means for connecting the first power supply line to a second power supply line at a connection point connecting a first point of the first power supply line and a second point of the second power supply line, the second point being included in a portion of the second power supply line excluding end portions of the second power supply line, and means for connecting the second power supply line to a voltage supplied circuit.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
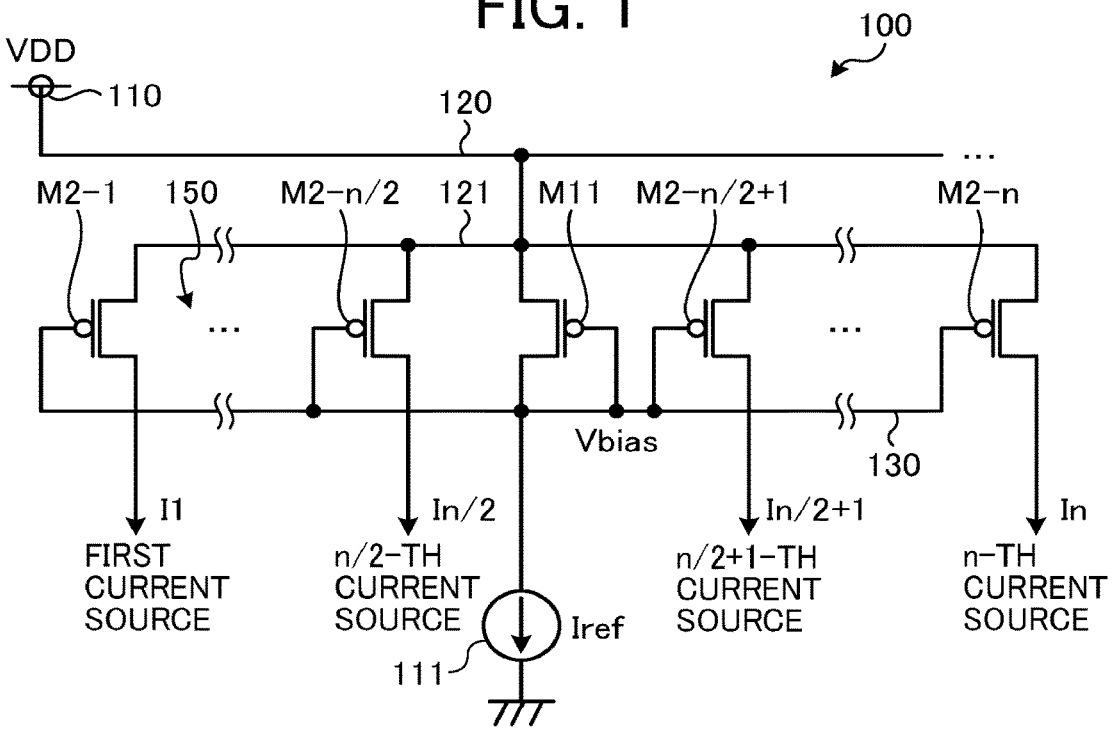
FIG. 1 is a diagram illustrating an exemplary configuration of a current mirror circuit according to a first embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. In the drawings illustrating embodiments of the present invention, members or components having the same function or shape will be denoted with the same reference numerals to avoid redundant description.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Semiconductor integrated circuits and power supply devices as embodiments of the present invention will be described in detail below with reference to the accompanying drawings.

A first embodiment of the present invention will be described.

FIG. 1 is a diagram illustrating an exemplary configuration of a current mirror circuit 100 according to the first embodiment. As illustrated in FIG. 1, the current mirror circuit 100 includes a reference current supply source 111, a power supply line 120 to which a power supply voltage VDD is supplied from a voltage supply source 110, a local power supply line 121, a bias line 130, a bias generating transistor M11, and current source transistors M2-1 to M2-*n* (n is an even number).

The current mirror circuit 100 is a semiconductor integrated circuit. The power supply line 120 is a first power supply line, and the local power supply line 121 is a second power supply line. The bias generating transistor M11 is a bias generating circuit, and the current source transistors M2-1 to M2-*n* are current generating circuits.

The local power supply line 121 supplies the source potential Vs to the bias generating transistor M11 and the current source transistors M2-1 to M2-*n*. FIG. 1 illustrates an example of the current mirror circuit 100 having the bias generating transistor M11 disposed at the center thereof. The bias generating transistor M11 and the current source transistors M2-1 to M2-*n* form a voltage supplied circuit 150. The current generated by each of the current source transistors M2-1 to M2-*n* serving as the current generating circuits is determined by the ratio between the size of each of the current source transistors M2-1 to M2-*n* and the size of the bias generating transistor M11. The bias generating transistor M11 and the current source transistors M2-1 to M2-*n* are each formed as a P-channel metal oxide semiconductor (Pch-MOS) transistor, and are the same in size. The current mirror circuit 100 and the voltage supply source 110 form a power supply device.

The bias generating transistor M11 receives the power supply voltage VDD supplied from the voltage supply source 110 and a reference current Iref supplied from the reference current supply source 111, and generates a bias voltage Vbias in accordance with the source potential Vs and the reference current Iref flowing through the bias generating transistor M11. The bias generating transistor M11 is disposed at the center of the local power supply line 121.

Each of the current source transistors M2-1 to M2-*n* receives the bias voltage Vbias generated by the bias generating transistor M11 as the gate potential Vg thereof, receives the power supply voltage on the local power supply line 121 as the source potential Vs thereof, and generates a current in accordance with the potential difference Vgs between the gate potential Vg and the source potential Vs. The current source transistors M2-1 to M2-*n* are equally divided and disposed on the right side and the left side of the bias generating transistor M11.

As illustrated in FIG. 1, in the current mirror circuit 100, the center of the local power supply line 121, which corresponds to the location of the bias generating transistor M11, is single-point connected to the power supply line 120.

As in FIG. 1, in which the center of the local power supply line 121 corresponding to the location of the bias generating transistor M11 is connected to the power supply line 120, it is desirable to connect the local power supply line 121 and the power supply line 120 such that the IR product, i.e., the product of the line resistance R and the current I flowing through the power supply line 120, is equal between the right side and the left side of a connection point of the local power supply line 121 and the power supply line 120. However, the IR product of the line resistance R and the current I flowing through the power supply line 120 is not required to be strictly equal between the right side and the left side of the connection point. For example, the IR product on the right side of the connection point and the IR product on the left side of the connection point may be equal within an error of ±10%. Further, the connection point may be at any position between the current source transistors M2-1 to M2-*n*, if the IR product of the line resistance R and the current I flowing through the power supply line 120 is equal between the right side and the left side of the connection point at that position. Further, although FIG. 1 illustrates an example of the current mirror circuit 100 including an even number of current source transistors for simplification of description, the current mirror circuit 100 may include an odd number of current source transistors.

A simulation result of the configuration of the current mirror circuit 100 will now be described. As a comparative example, a simulation result of the configuration of a related-art current mirror circuit will first be described.

Figure 2:
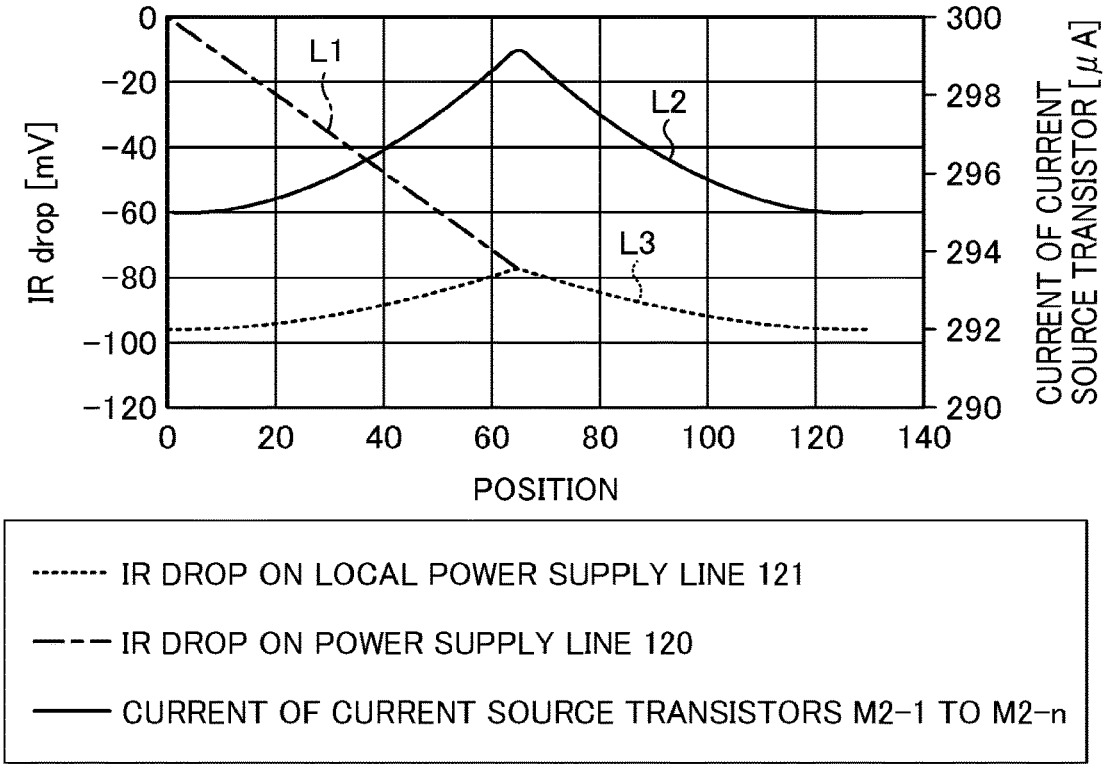
FIG. 2 is a graph illustrating a simulation result of the configuration of the current mirror circuit according to the first embodiment.
Figure 3:
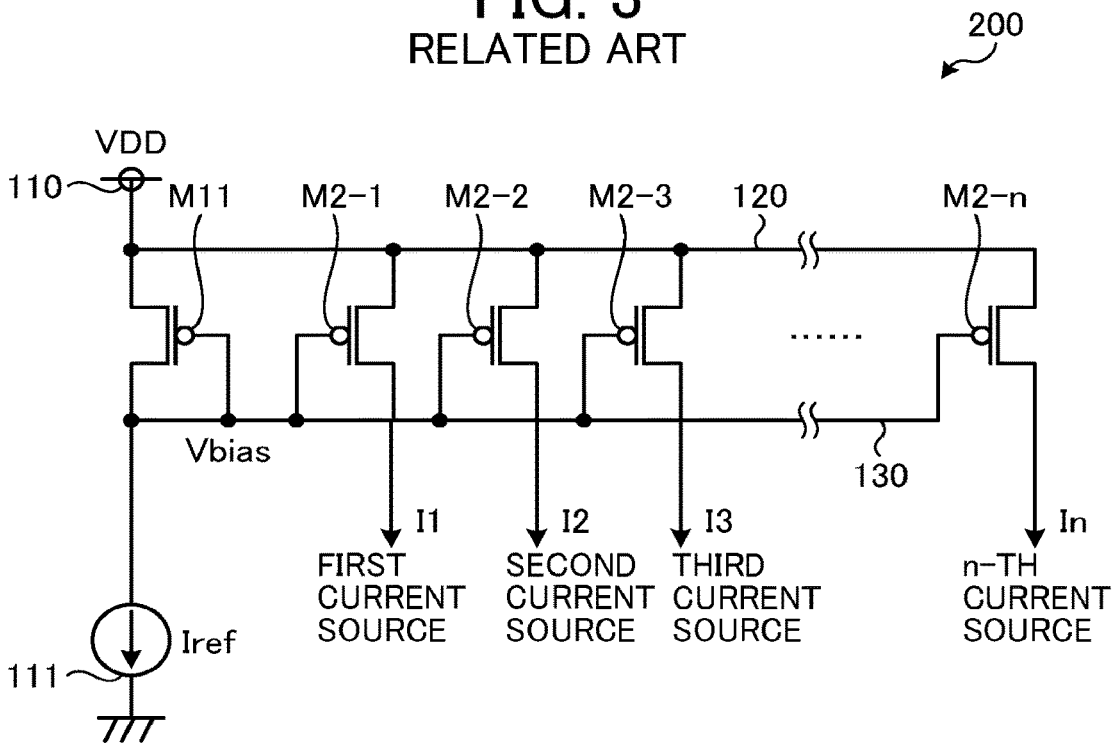
FIG. 3 RELATED ART
FIG. 3 is a diagram illustrating an exemplary configuration of a related-art current mirror circuit.
Figure 4:
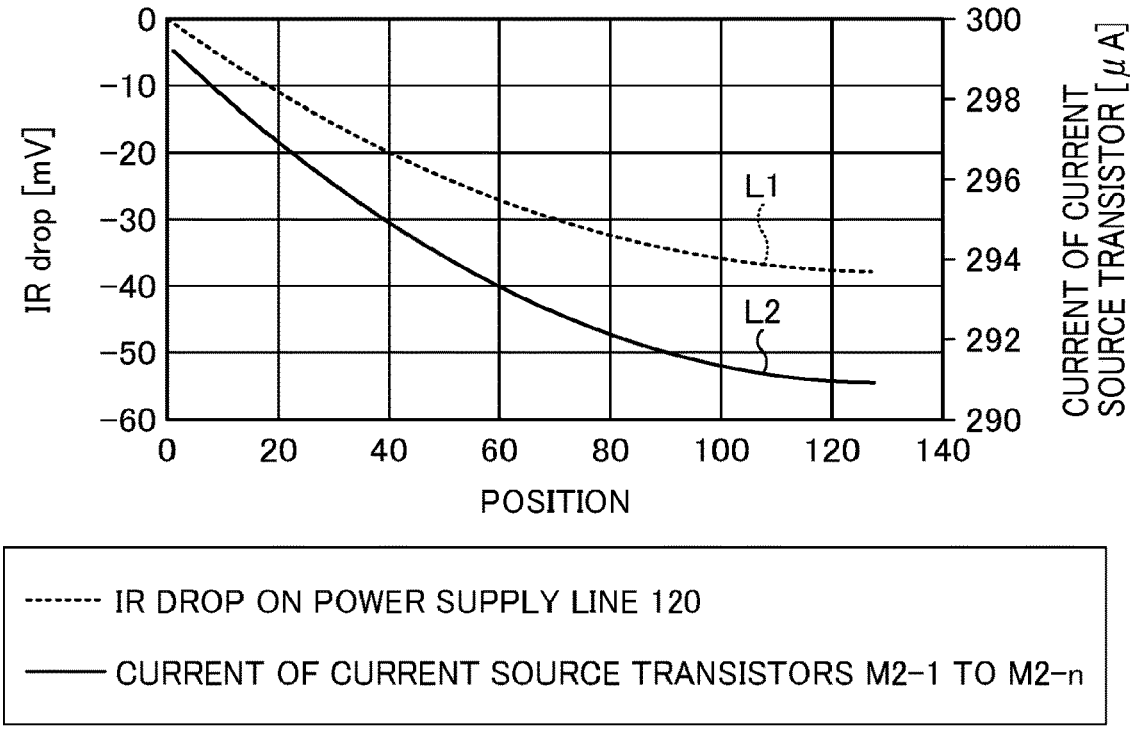
FIG. 4 RELATED ART
FIG. 4 is a graph illustrating a simulation result of the configuration of the related-art current mirror circuit.

FIG. 2 is a graph illustrating a simulation result of the configuration of the current mirror circuit 100. FIG. 3 is a diagram illustrating an exemplary configuration of a related-art current mirror circuit 200. FIG. 4 is a graph illustrating a simulation result of the configuration of the related-art current mirror circuit 200.

As illustrated in FIG. 3, the related-art current mirror circuit 200 includes the voltage supply source 110, the bias generating transistor M11, and the current source transistors M2-1 to M2-*n*. The bias generating transistor M11 receives the power supply voltage VDD supplied from the voltage supply source 110 and the reference current Iref supplied from the reference current supply source 111, and generates the bias voltage Vbias in accordance with the source potential Vs thereof and the reference current Iref flowing through the bias generating transistor M11. Each of the current source M2-1 to M2-*n* receives the bias voltage Vbias generated by the bias generating transistor M11 as the gate potential Vg thereof, receives the potential on the power supply line 120 as the source potential Vs thereof, and generates a current in accordance with the potential difference Vgs between the gate potential Vg and the source potential Vs.

In the ideal state, the gate potential Vg and the source potential Vs are constant in any current source transistor. If the bias generating transistor M11 and the current source transistors M2-1 to M2-*n* are the same in size, therefore, currents I1, I2, and I3, . . . , and In flowing therethrough have a relationship: Iref=I1=I2=I3= . . . =In. Accordingly, the related-art current mirror circuit 200 is capable of copying a current with a substantially simple configuration.

In reality, however, the voltage drop determined by the IR product of the line resistance R and the current I flowing through the power supply line 120 occurs on the power supply line 120. Consequently, the currents Iref, I1, I2, I3, . . . , and In are not equal, and the value of each of the currents I1, I2, I3, . . . , and In is deviated from the value of the reference current Iref by the value of the voltage drop (i.e., the IR drop).

FIG. 4 illustrates a simulation result of the configuration of the related-art current mirror circuit 200 obtained under conditions in which the line resistance R of the power supply line 120 is 2Ω, the number n of current source transistors is 128, and the reference current Iref is 300 μA.

In FIG. 4, L1 represents the IR drop on the power supply line 120, and L2 represents the value of the current generated by the current source transistors M2-1 to M2-*n*.

As illustrated in FIG. 4, it is understood that, in the related-art current mirror circuit 200, the value L2 of the current generated by the current source transistors M2-1 to M2-*n* decreases with the IR drop L1 on the power supply line 120, thereby causing a deviation in current value of approximately 8 μA.

FIG. 2 illustrates a simulation result of the configuration of the current mirror circuit 100 obtained under conditions in which the line resistance R of the power supply line 120 is 4Ω, a line resistance Rlocal of the local power supply line 121 is 4Ω, the number n of current source transistors is 128, and the reference current Iref is 300 μA. The power supply line 120 and the local power supply line 121 of the current mirror circuit 100 are obtained by bisecting a power supply line having the same width as that of the power supply line 120 used in the related-art current mirror circuit 200 in FIG. 3.

According to the configuration of the current mirror circuit 100, the current source transistors M2-1 to M2-*n* are divided and disposed on the right side and the left side of the local power supply line 121. Thereby, the current flowing through one line is divided into a current flowing through the right side of the line and a current flowing through the left side of the line. Further, the configuration of the current mirror circuit 100 includes the local power supply line 121 in addition to the power supply line 120. Therefore, the line resistance per unit length is doubled, provided that the line area of the current mirror circuit 100 is the same as that of the related-art current mirror circuit 200 illustrated in FIG. 3.

That is, the configuration of the current mirror circuit 100 includes the local power supply line 121 and the current source transistors M2-1 to M2-*n* divided and disposed on the right side and the left side of the local power supply line 121. This configuration therefore halves the line resistance and halves the current flowing through a line, thereby reducing the IR drop by half.

In FIG. 2, L1 represents the IR drop on the power supply line 120. L2 represents the value of the current generated by the current source transistors M2-1 to M2-*n* when the bias generating transistor M11 is disposed at the center of the local power supply line 121. L3 represents the IR drop on the local power supply line 121.

As compared with the simulation result of the related-art current mirror circuit 200 illustrated in FIG. 4, the simulation result of the current mirror circuit 100 has an increase in line resistance due to the bisecting of the line, thereby increasing the IR drop L1 on the power supply line 120. In the current mirror circuit 100, however, the bias generating transistor M11 generates the bias voltage Vbias with reference to the potential corresponding to the peak of the IR drop L3 on the local power supply line 121 illustrated in FIG. 2. Consequently, the value L2 of the current generated by the current source transistors M2-1 to M2-*n* is obtained as illustrated in FIG. 2.

According to the current mirror circuit 100, therefore, the IR drop is equalized between opposite end portions of the local power supply line 121, and the power supply line 120 and the local power supply line 121 are connected at the point at which the difference in the IR drop therebetween is minimized. Accordingly, the current mirror circuit 100 reduces the IR drop on the local power supply line 121, thereby reducing the deviation in current value to approximately 4 μA from approximately 8 μA in the simulation result of the related-art current mirror circuit 200 illustrated in FIG. 4.

As described above, the first embodiment enables a reduction in the IR drop on a power supply line without a complicated configuration, while improving the area efficiency. Accordingly, the current mirror circuit 100 copies a current with improved accuracy.

A second embodiment of the present invention will now be described.

In the first embodiment, the bias generating transistor M11 is disposed at the center of the local power supply line 121. The second embodiment is different from the first embodiment in that the bias generating transistor M11 is disposed at a position other than the center of the local power supply line 121. The following description of the second embodiment will focus on differences from the first embodiment, and description of the same parts as those of the first embodiment will be omitted.

Figure 5:
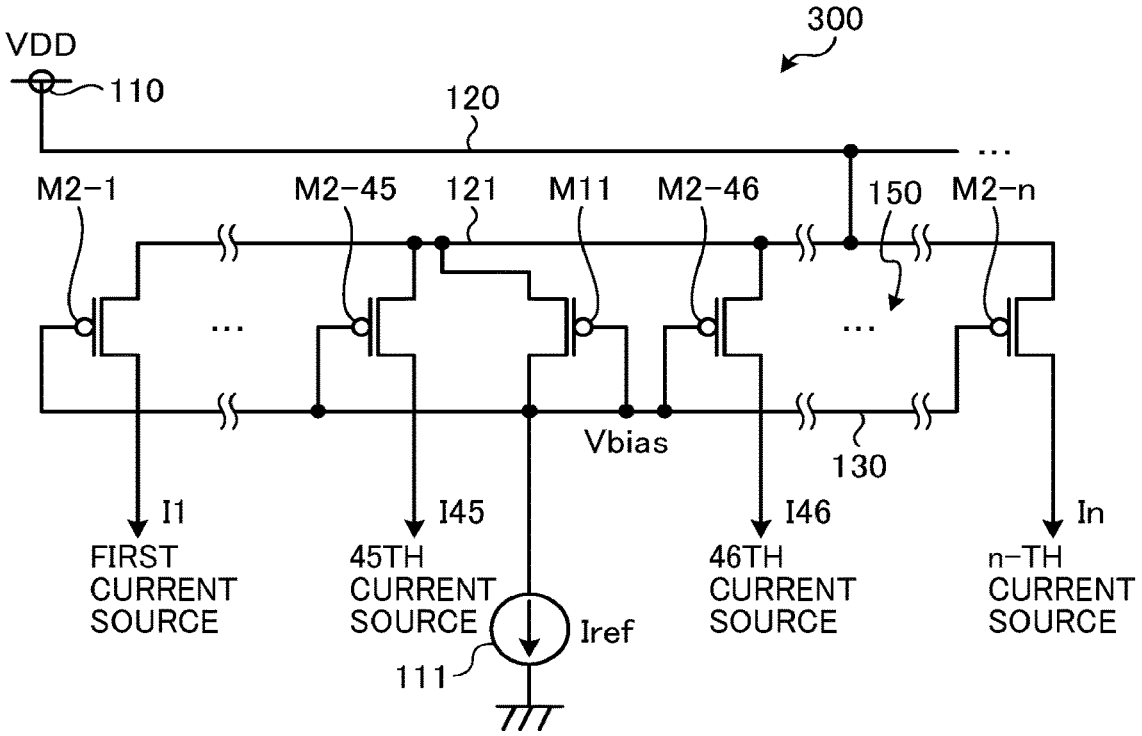
FIG. 5 is a diagram illustrating an exemplary configuration of a current mirror circuit according to a second embodiment of the present invention.

FIG. 5 is a diagram illustrating an exemplary configuration of a current mirror circuit 300 according to the second embodiment. As compared with the circuit configuration of the current mirror circuit 100 according to the first embodiment, the current mirror circuit 300 according to the second embodiment illustrated in FIG. 5 is an example in which the bias generating transistor M11 is disposed on the left side of the connection point of the power supply line 120 and the local power supply line 121 in FIG. 5.

Specifically, the bias generating transistor M11 is disposed and supplied with a voltage at a position corresponding to a central portion of the IR drop on the local power supply line 121 (i.e., a portion of the IR drop on the local power supply line 121 near the center of the IR drop). More specifically, when the IR drop on the local power supply line 121 is assumed to have a maximum value of 95 mv and a minimum value of 77 mv, the bias generating transistor M11 is disposed and supplied with a voltage at a position on a line at which the IR drop on the local power supply line 121 has a value close to 86 my, i.e., the mean of the maximum value and the minimum value. With the source potential Vs thus set with errors in the positive and negative directions, the absolute value of the deviation of the copied current from the reference current Iref is minimized. The bias generating transistor M11 is not required to be disposed precisely at the position corresponding to the mean of the maximum value and the minimum value of the IR drop occurring on the local power supply line 121, and may be positioned with an error of up to ±10%, for example. Further, the bias generating transistor M11 may be disposed at any position between the current source transistors M2-1 to M2-*n*, if the mean of the maximum value and the minimum value of the IR drop is obtained at the position.

It is significant for the bias generating transistor M11 to be supplied with the voltage dropped to 86 mv from the potential of the voltage supply source 110 by the IR drop. Although the disposition position of the bias generating transistor M11 is not particularly limited, it is desirable, in consideration of connection to the power supply line 120, to dispose the bias generating transistor M11 near a position on a line at which the IR drop on the local power supply line 121 has a value close to the mean of 86 mv.

As illustrated in the example of FIG. 5, in the current mirror circuit 300 according to the second embodiment, the bias generating transistor M11 is disposed on the left side of the connection point of the power supply line 120 and the local power supply line 121. However, the bias generating transistor M11 is not limited to this position, and may be disposed at the position corresponding to the central portion of the IR drop on the local power supply line 121. For example, the bias generating transistor M11 may be disposed on the right side of the connection point of the power supply line 120 and the local power supply line 121.

Figure 6:
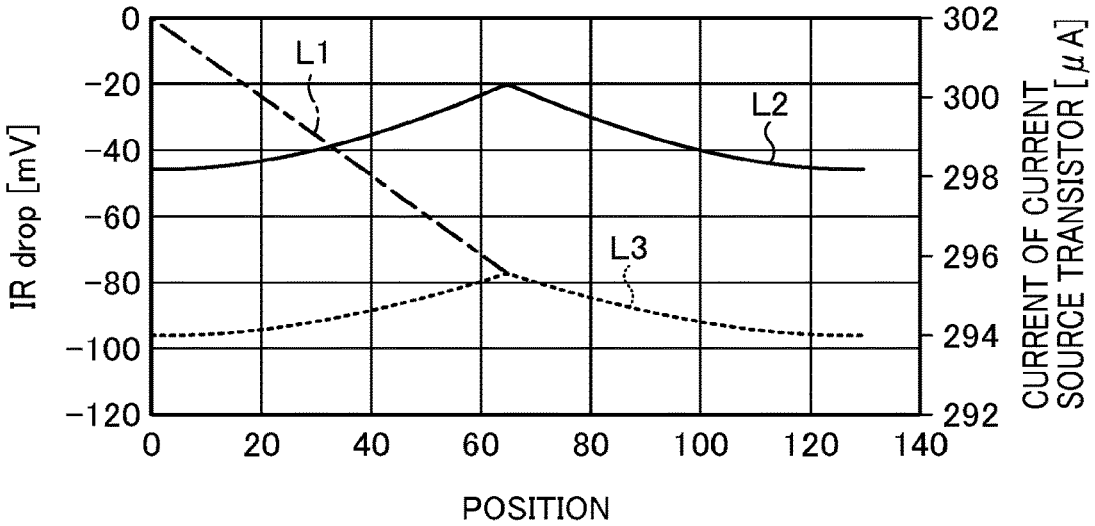
FIG. 6 is a graph illustrating a simulation result of the configuration of the current mirror circuit according to the second embodiment.

FIG. 6 is a graph illustrating a simulation result of the configuration of the current mirror circuit 300. FIG. 6 illustrates a simulation result of the configuration of the current mirror circuit 300 obtained under conditions in which the line resistance R of the power supply line 120 is 4Ω, the line resistance Rlocal of the local power supply line 121 is 4Ω, the number n of current source transistors is 128, and the reference current Iref is 300 μA. The power supply line 120 and the local power supply line 121 of the current mirror circuit 300 are obtained by bisecting a power supply line having the same width as that of the power supply line 120 used in the related-art current mirror circuit 200 in FIG. 3.

The current generated by a transistor is proportional to the value $(Vgs-Vth)^2$, i.e., the square of the difference between the potential difference Vgs and the threshold voltage Vth. The bias voltage Vbias (i.e., the gate potential Vg) generated by the bias generating transistor M11 is constant. Further, if factors such as variation and the back bias effect are not taken into account, the threshold voltage Vth is constant.

The configuration of the current mirror circuit 300 reduces the absolute value of the deviation of the power supply voltage (i.e., the source potential Vs) supplied to each of the current source transistors M2-1 to M**2-*n* from the power supply voltage (i.e., the source potential Vs) supplied to the bias generating transistor M11. The configuration of the current mirror circuit 300 therefore reduces the deviation of the value of the copied current from the intended value, i.e., the value of the reference current Iref. In the second embodiment, the deviation of the source potential Vs supplied to each of the current source transistors M2-1 to M2-*n* from the source potential Vs supplied to the bias generating transistor M11** is ±9 mv.

In FIG. 6, L1 represents the IR drop on the power supply line 120, and L2 represents the value of the current generated by the current source transistors M2-1 to M**2-*n* when the bias generating transistor M11 is disposed at the position corresponding to the center of the IR drop on the local power supply line 121. Further, L3 represents the IR drop on the local power supply line 121**.

In the simulation result of the current mirror circuit 100 illustrated in FIG. 2, the maximum value of the deviation of the value L2 of the current generated by the current source transistors M2-1 to M**2-*n* from the value of 300 μA of the reference current Iref is approximately 4 μA. In the simulation result of the current mirror circuit 300 illustrated in FIG. 6, on the other hand, the maximum value of this deviation is further reduced to approximately 2 μA. This effect of reducing the maximum value of the deviation is also obtainable in the related-art current mirror circuit 200 illustrated in FIG. 3 by applying thereto the configuration of the current mirror circuit 300**.

As described above, the second embodiment enables a reduction in the IR drop on a power supply line without a complicated configuration, while improving the area efficiency. Accordingly, the current mirror circuit 300 copies a current with improved accuracy.

A third embodiment of the present invention will now be described.

The third embodiment is different from the first embodiment in having local power supply lines at four locations. The following description of the third embodiment will focus on differences from the first embodiment, and description of the same parts as those of the first embodiment will be omitted.

Figure 7:
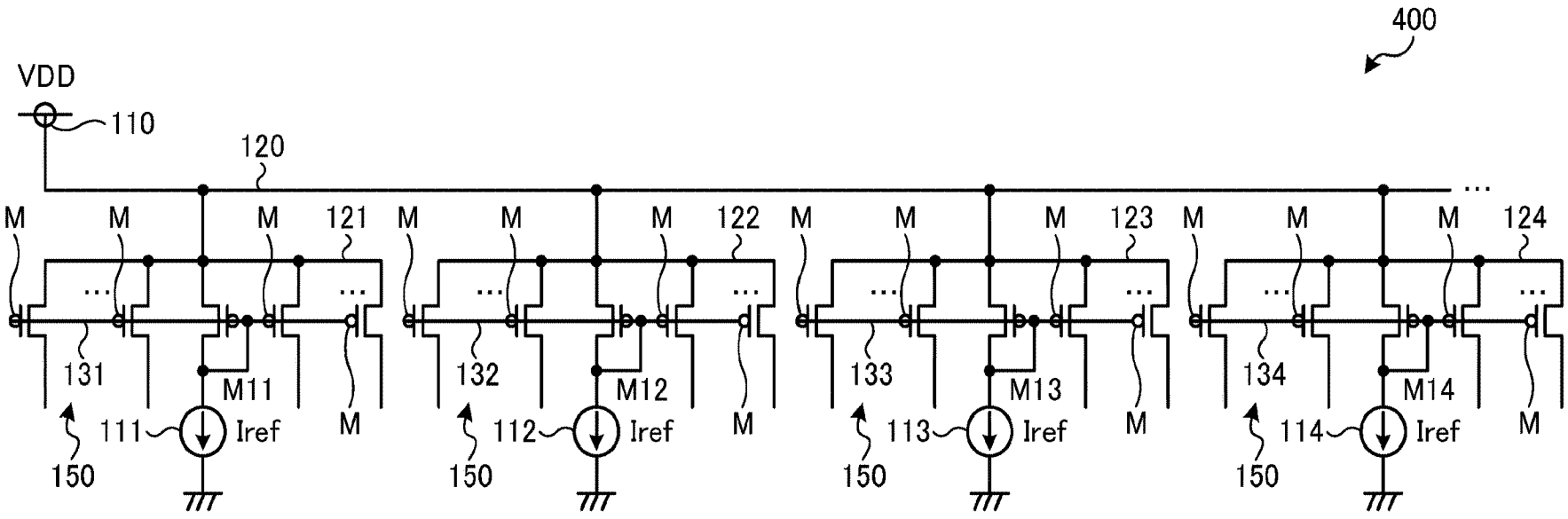
FIG. 7 is a diagram illustrating an exemplary configuration of a current mirror circuit according to a third embodiment of the present invention.

FIG. 7 is a diagram illustrating an exemplary configuration of a current mirror circuit 400 according to the third embodiment. As illustrated in FIG. 7, the current mirror circuit 400 according to the third embodiment includes the power supply line 120 connected to the voltage supply source 110, reference current supply sources 111, 112, 113, and 114, and local power supply lines 121, 122, 123, and 124 connected to the reference current supply sources 111, 112, 113, and 114, respectively, and single-point connected to respective local points of the power supply line 120. In the current mirror circuit 400, a central portion of each of the local power supply lines 121 to 124 is connected to a given position on the power supply line 120.

In the current mirror circuit 400, bias generating transistors M11, M12, M13, and M14 are disposed near the respective centers of the local power supply lines 121, 122, 123, and 124. Each of the bias generating transistors M11 to M14 generates a bias voltage in accordance with the power supply voltage (i.e., the source potential Vs) supplied thereto and the value of the current flowing therethrough. The bias voltage is supplied to the gates of corresponding current source transistors M via a corresponding one of bias lines 131, 132, 133, and 134. Each of the current source transistors M receives the bias voltage, and generates a current in accordance with the potential difference Vgs between the power supply voltage (i.e., the source potential Vs) and the gate potential Vg.

In reality, the change in the power supply voltage due to the IR drop causes differences between the potential differences Vgs of the bias generating transistors M11 to M14, thereby causing slight differences between the copied currents. That is, the optimal disposition position of each of the bias generating transistors M11 to M14 depends on the connection point of the corresponding one of the local power supply lines 121 to 124 and the power supply line 120. In the current mirror circuit 400 of the third embodiment, therefore, the local power supply lines 121 to 124 have different connection points to the power supply line 120.

In the present example, the bias voltage is constant on the bias lines 131 to 134. The power supply voltage, on the other hand, has different potentials depending on the location owing to the IR drops caused by the currents flowing through the local power supply lines 121 to 124 and the resistances of the local power supply lines 121 to 124.

In the configuration of the current mirror circuit 400, however, the current source transistors M are provided for each of the local power supply lines 121 to 124, and the current flowing through each of the local power supply lines 121 to 124 is divided into a current flowing through the right side thereof and a current flowing through the left side thereof. Accordingly, the IR drops on the local power supply lines 121 to 124 are substantially reduced.

Further, according to the configuration of the current mirror circuit 400, the line resistance R of the power supply line 120 is not required to be small, if the line resistance R of the power supply line 120 does not prevent the saturated operation of the transistors forming the current mirror circuit 400. The configuration of the current mirror circuit 400 therefore enables an overall reduction in the line width and a reduction in the circuit area.

Figure 8:
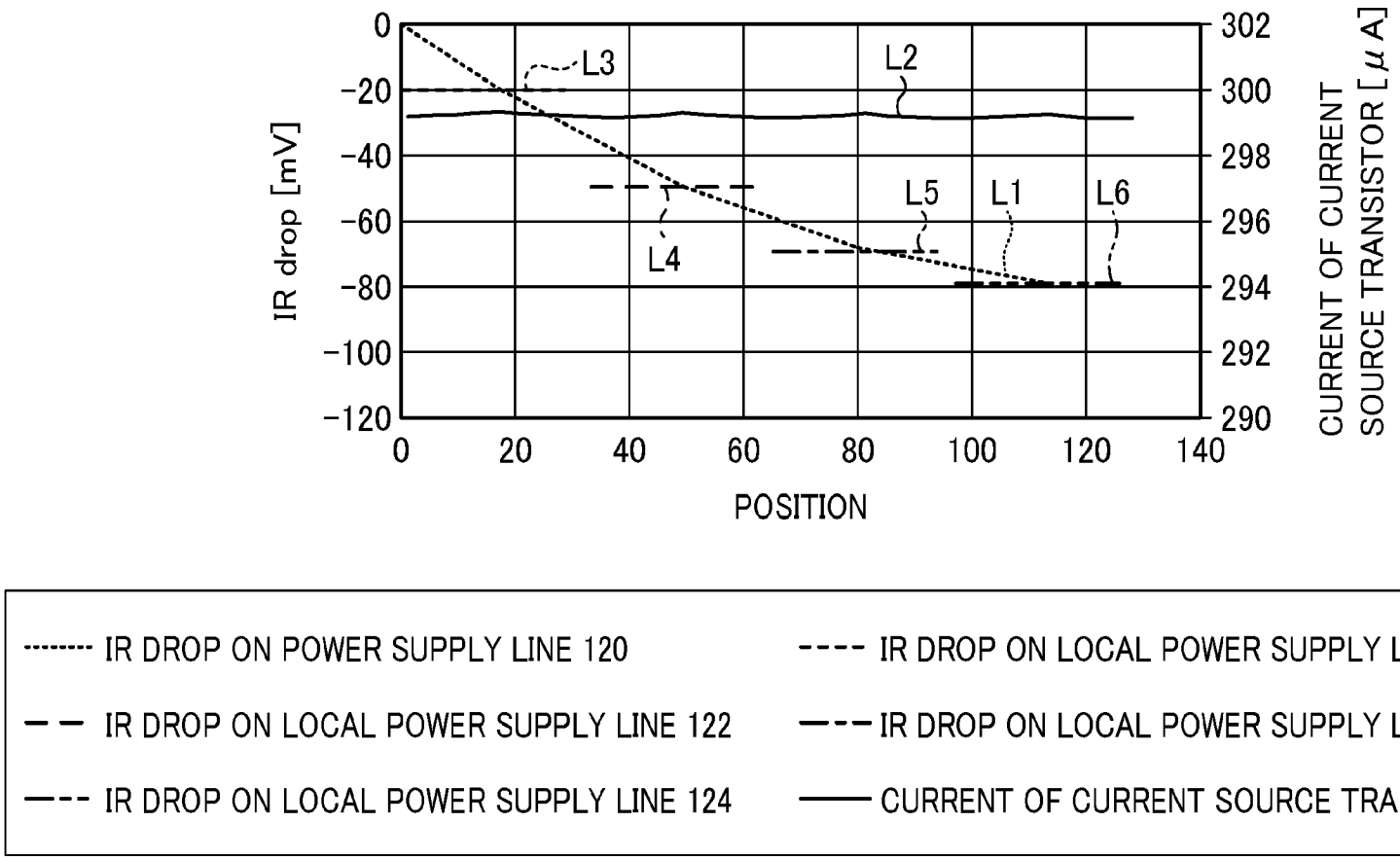
FIG. 8 is a graph illustrating a simulation result of the configuration of the current mirror circuit according to the third embodiment.

FIG. 8 is a graph illustrating a simulation result of the configuration of the current mirror circuit 400. FIG. 8 illustrates a simulation result of the configuration of the current mirror circuit 400 obtained under conditions in which the line resistance R of the power supply line 120 is 4Ω, the line resistance Rlocal of each of the local power supply lines 121 to 124 is 1Ω, the number n of current source transistors is 128, the number of current source transistors for each of the local power supply lines 121 to 124 is 32, and the reference current Iref is 300 μA. The power supply line 120 of the current mirror circuit 400 is the same as that of the current mirror circuit 100 in FIG. 1 or the current mirror circuit 300 in FIG. 5, and the local power supply lines 121 to 124 of the current mirror circuit 400 are obtained by quadrisecting the local power supply line 121 of the current mirror circuit 100 in FIG. 1 or the current mirror circuit 300 in FIG. 5 in the longitudinal direction thereof.

In FIG. 8, L1 represents the IR drop on the power supply line 120, and L2 represents the value of the current generated by the current source transistors M when each of the bias generating transistors M11 to M14 is disposed at the center of the corresponding one of the local power supply lines 121 to 124. Further, L3 represents the IR drop on the local power supply line 121, and L4 represents the IR drop on the local power supply line 122. Further, L5 represents the IR drop on the local power supply line 123, and L6 represents the IR drop on the local power supply line 124.

According to the configuration of the current mirror circuit 400, the IR drop on the power supply line 120 is large. However, each of the bias generating transistors M11 to M14 generates the bias voltage with reference to the power supply voltage at the center of the corresponding one of the local power supply lines 121 to 124. Further, according to the configuration of the current mirror circuit 400, the current source transistors M are provided for each of the local power supply lines 121 to 124. Consequently, the IR drops on the local power supply lines 121 to 124 are reduced, thereby substantially reducing the deviation in current value.

As described above, the third embodiment enables a reduction in the IR drop on a power supply line without a complicated configuration, while improving the area efficiency. Accordingly, the current mirror circuit 400 copies a current with improved accuracy.

In each of the above-described embodiment examples, the current mirror circuit is configured as a Pch-MOS transistor. However, the current mirror circuit is not limited thereto, and may be configured as a different type of transistor such as an N-channel (Nch)-MOS transistor or a bipolar transistor, or may be configured as an active element or a passive element.

Further, in each of the current mirror circuits of the embodiments, each of the current source transistors and the bias generating transistor(s) may be configured as a cascode connection circuit. With this configuration, the accuracy of the copied current is further improved.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A semiconductor integrated circuit, comprising:

a first power supply line connected to a voltage supply source;

a second power supply line connected to the first power supply line at a connection point connecting a first point of the first power supply line and a second point of the second power supply line, the second point being included in a portion of the second power supply line excluding end portions of the second power supply line; and a voltage supplied circuit connected to the second power supply line, wherein the voltage supplied circuit includes a bias generating circuit configured to generate a bias voltage in accordance with a power supply voltage supplied from the voltage supply source via the second power supply line and a reference current supplied from a reference current supply source, and a plurality of current generating circuits each configured to generate a current in accordance with the power supply voltage supplied via the second power supply line and the bias voltage generated at the bias generating circuit; and wherein the bias generating circuit is disposed at a position at which a mean of a maximum value and a minimum value of a current-resistance drop occurring on the second power supply line is obtained.

2. The semiconductor integrated circuit of claim 1, wherein the second power supply line includes a first segment stretching from one end of the second power supply line to the connection point and a second segment stretching from other one end of the second power supply line to the connection point, and wherein the connection point connecting the first power supply line and the second power supply line is set at a position at which a product of a value of a line resistance of the first segment and a value of a current flowing through the first segment is equal to a product of a value of a line resistance of the second segment and a value of a current flowing through the second segment.

3. The semiconductor integrated circuit of claim 1, wherein the second power supply line includes a plurality of second power supply lines, and the voltage supplied circuit includes a plurality of voltage supplied circuits, and wherein the first power supply line is connected to a plurality of units each including one of the plurality of second power supply lines and one of the plurality of voltage supplied circuits that is connected to the one of the plurality of second power supply lines.

4. The semiconductor integrated circuit of claim 3, wherein the plurality of second power supply lines connected to the plurality of voltage supplied circuits are different from each other in the connection point to the first power supply line.

5. The semiconductor integrated circuit of claim 1, wherein the bias generating circuit is disposed at a position other than the connection point.

6. The semiconductor integrated circuit of claim 1, wherein the current generated by each of the plurality of current generating circuits is determined by a ratio between a size of a transistor forming the each of the plurality of current generating circuits and a size of a transistor forming the bias generating circuit.

7. The semiconductor integrated circuit of claim 1, wherein each of the plurality of current generating circuits and the bias generating circuit is configured as a cascode connection circuit.

8. A power supply device comprising:

the semiconductor integrated circuit of claim 1; and a voltage supply source from which a power supply voltage is supplied.

9. A semiconductor integrated circuit, comprising:

means for connecting a voltage supply source to a first power supply line;

means for connecting the first power supply line to a second power supply line at a connection point connecting a first point of the first power supply line and a second point of the second power supply line, the second point being included in a portion of the second power supply line excluding end portions of the second power supply line; and means for connecting the second power supply line to a voltage supplied circuit, wherein the means for connecting the second power supply line includes a bias generating circuit configured to generate a bias voltage in accordance with a power supply voltage supplied from the voltage supply source via the second power supply line and a reference current supplied from a reference current supply source, and a plurality of current generating circuits each configured to generate a current in accordance with the power supply voltage supplied via the second power supply line and the bias voltage generated at the bias generating circuit; and wherein the bias generating circuit is disposed at a position at which a mean of a maximum value and a minimum value of a current-resistance drop occurring on the second power supply line is obtained.

10. A semiconductor integrated circuit, comprising:

a first power supply line connected to a voltage supply source;

a second power supply line connected to the first power supply line at a connection point connecting a first point of the first power supply line and a second point of the second power supply line, the second point being included in a portion of the second power supply line excluding end portions of the second power supply line; and a voltage supplied circuit connected to the second power supply line, wherein the second power supply line includes a plurality of second power supply lines, and the voltage supplied circuit includes a plurality of voltage supplied circuits, and wherein the first power supply line is connected to a plurality of units, each including one of the plurality of second power supply lines and one of the plurality of voltage supplied circuits, which is connected to the one of the plurality of second power supply lines.

11. The semiconductor integrated circuit of claim 1, further comprising:

only one bias generating circuit, which is configured to generate a bias voltage in accordance with a power supply voltage supplied from the voltage supply source via the second power supply line and a reference current supplied from a reference current supply source.

* * * * *